US011264156B2

(12) United States Patent
Ohta et al.

(10) Patent No.: US 11,264,156 B2
(45) **Date of Patent: *Mar. 1, 2022**

(54) MAGNETIC CORE BASED ON A NANOCRYSTALLINE MAGNETIC ALLOY

(71) Applicants: METGLAS, INC., Conway, SC (US); HITACHI METALS, LTD., Tokyo (JP)

(72) Inventors: Motoki Ohta, Conway, SC (US); Naoki Ito, Myrtle Beach, SC (US)

(73) Assignees: METGLAS, INC., Conway, SC (US); HITACHI METALS, LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/591,491

(22) Filed: Jan. 7, 2015

(65) Prior Publication Data

US 2016/0196908 A1 Jul. 7, 2016

(51) Int. Cl.
*H01F 5/00* (2006.01)
*H01F 27/28* (2006.01)
(Continued)

(52) U.S. Cl.
CPC ..... *H01F 3/04* (2013.01); *C21D 1/04* (2013.01); *C21D 8/125* (2013.01); *C21D 9/52* (2013.01);
(Continued)

(58) Field of Classification Search
CPC ..... H01F 5/00; H01F 27/28
(Continued)

(56) References Cited

U.S. PATENT DOCUMENTS 5,072,205 A * 12/1991 Arakawa ..... H01F 1/15383 336/213
5,611,871 A 3/1997 Yoshizawa et al.
(Continued)

FOREIGN PATENT DOCUMENTS

CN 102282633 12/2011
CN 103502481 1/2014
(Continued)

OTHER PUBLICATIONS

Written Opinion of the International Searching Authority for related PCT Application No. PCT/US16/12184, dated Apr. 1, 2016.
(Continued)

*Primary Examiner* — Tszfung J Chan

(57) ABSTRACT

A magnetic core includes a nanocrystalline alloy ribbon having a composition represented by $FeCu_xB_ySi_zA_aX_b$, where $0.6 \le x < 1.2$, $10 \le y \le 20$, $0 \le (y+z) \le 24$, and $0 \le a \le 10$, $0 \le b \le 5$, all numbers being in atomic percent, with the balance being Fe and incidental impurities, and where A is an optional inclusion of at least one element selected from Ni, Mn, Co, V, Cr, Ti, Zr, Nb, Mo, Hf, Ta and W, and X is an optional inclusion of at least one element selected from Re, Y, Zn, As, In, Sn, and rare earth elements. The nanocrystalline alloy ribbon has a local structure such that nanocrystals with average particle sizes of less than 40 nm are dispersed in an amorphous matrix and are occupying more than 30 volume percent of the ribbon.

21 Claims, 11 Drawing Sheets

(51) Int. Cl.

| | |
|---|---|
| ***H01F 3/04*** | (2006.01) |
| ***C21D 8/12*** | (2006.01) |
| ***C21D 9/52*** | (2006.01) |
| ***C22C 38/16*** | (2006.01) |
| ***C22C 38/12*** | (2006.01) |
| ***C22C 38/02*** | (2006.01) |
| ***C22C 38/00*** | (2006.01) |
| ***H01F 1/153*** | (2006.01) |
| ***H01F 41/02*** | (2006.01) |
| ***C22C 45/02*** | (2006.01) |
| ***C21D 1/04*** | (2006.01) |

(52) U.S. Cl.
CPC ..... *C22C 38/002* (2013.01); *C22C 38/02* (2013.01); *C22C 38/12* (2013.01); *C22C 38/16* (2013.01); *C22C 45/02* (2013.01); *H01F 1/15333* (2013.01); *H01F 41/0226* (2013.01); *C21D 2201/03* (2013.01); *H01F 1/15308* (2013.01)

(58) Field of Classification Search
USPC ..... 336/200, 232
See application file for complete search history.

(56) References Cited

U.S. PATENT DOCUMENTS

| | | | | |
|---|---|---|---|---|
| 5,911,840 | A | 6/1999 | Couderchon et al. | |
| 6,425,960 | B1 | 7/2002 | Yoshizawa et al. | |
| 8,007,600 | B2 | 8/2011 | Ohta et al. | |
| 8,177,923 | B2 | 5/2012 | Ohta et al. | |
| 8,287,666 | B2 * | 10/2012 | Ohta | B22D 11/06 148/305 |
| 8,491,731 | B2 * | 7/2013 | Makino | C21D 5/00 148/121 |
| 2008/0196795 | A1 * | 8/2008 | Waeckerle | H01F 1/153 148/540 |
| 2009/0266448 | A1 * | 10/2009 | Ohta | B22D 11/06 148/121 |
| 2010/0043927 | A1 | 2/2010 | Makino | |
| 2010/0230010 | A1 * | 9/2010 | Yoshizawa | B82Y 30/00 148/304 |
| 2011/0272065 | A1 * | 11/2011 | Ohta | B82Y 25/00 148/540 |
| 2012/0199254 | A1 | 8/2012 | Urata et al. | |
| 2012/0318412 | A1 * | 12/2012 | Ohta | C21D 8/1211 148/548 |
| 2014/0104024 | A1 * | 4/2014 | Herzer | H01F 1/047 335/297 |
| 2014/0152416 | A1 * | 6/2014 | Herzer | H01F 1/15333 336/233 |
| 2014/0191832 | A1 | 7/2014 | Ohta et al. | |

FOREIGN PATENT DOCUMENTS

| | | | | |
|---|---|---|---|---|
| EP | 2894236 | A1 | 7/2015 | |
| JP | 5-3126 | | 1/1993 | |
| JP | 2004-353090 | | 12/2004 | |
| JP | 2004353090 | A * | 12/2004 | H01F 1/15333 |
| JP | 2004353090 | A * | 12/2004 | H01F 1/15333 |
| JP | 2007-107095 | | 4/2007 | |
| JP | WO 2008133301 | A1 * | 11/2008 | C21D 6/00 |
| JP | WO 2009123100 | A1 * | 10/2009 | B82Y 30/00 |
| JP | 2010-18976 | | 9/2010 | |
| JP | 2011-26706 | | 2/2011 | |
| JP | 2012-12699 | | 1/2012 | |
| JP | 2012-199506 | | 10/2012 | |
| JP | 5455040 | | 1/2014 | |
| JP | 2014-125675 | | 7/2014 | |
| JP | 2014-516386 | | 7/2014 | |
| JP | 2014125675 | A * | 7/2014 | |
| JP | 2014-240516 | | 12/2014 | |
| JP | 2015-95500 | | 5/2015 | |
| JP | 2015-157999 | | 9/2015 | |
| WO | WO 2007/032531 | A1 | 3/2007 | |
| WO | WO 2008/133301 | A1 | 11/2008 | |
| WO | WO-2008133301 | A * | 11/2008 | H01F 1/15333 |
| WO | WO 2011/122589 | A1 | 10/2011 | |
| WO | WO 2012/140550 | A1 | 10/2012 | |
| WO | WO 2014/038705 | A1 | 3/2014 | |

OTHER PUBLICATIONS

International Search Report for related PCT Application No. PCT/US16/12184, dated Apr. 1, 2016.
Hitachi Metals, Ltd., "Nanocrystaltine soft magnetic material FINEMET", Printed Apr. 2005. Available online Mar. 11, 2006; Retrieved online: http://www.hilltech.com/pdf/hl-fm10-cFinemetintro.pdf; pp. 1-12.
Francoeur, B et al., "Continuous-annealing method for producing a flexible, curved, soft magnetic amorphous alloy ribbon", Journal of Applied Physics, vol. 111. pp. 07A309-1-07A309-3, Feb. 14, 2012.
Griner, S et al., "Structure and properties changes of Fe78Si9B13 metallic glass by low-temperature thermal activation process", Journal of Achievements in Materials and Manufacturing Engineering, vol. 50. Issue 1, Jan. 1, 2012, pp. 18-25.
U.S. Appl. No. 14/591,478, filed Jan. 7, 2015, Ohta et al., (1) Metglas, Inc. and (2) Hitachi Metals, Ltd.
Written Opinion of the International Searching Authority for a related PCT Application No. PCT/US16/1218, dated Mar. 16, 2016.
International Preliminary Report on Patentability dated Feb. 17, 2017 in corresponding International Patent Application No. PCT/US16/12181.
Taiwanese Office Action dated Mar. 30, 2017 in corresponding Taiwanese Patent Application No. 105100421.
Written Opinion of the International Searching Authority for a related PCT Application No. PCT/US16/12181, dated Mar. 16, 2016.
International Search Report for a related PCT Application No. PCT/US16/12181, dated Mar. 16, 2016.
International Preliminary Report on Patentability for related PCT Application No. PCT/US16/12184, dated Dec. 30, 2016.
Taiwanese Office Action for a related Taiwanese Patent Application No. 105100422, dated Oct. 6, 2016.
Extended European Search Report dated Jun. 13, 2018 in European Patent Application No. 16735299.6.
Extended European Search Report dated Jun. 13, 2018 in European Patent Application No. 16735298.8.
Japanese Office Action in Japanese Patent Application No. 2017-536007, dated Sep. 28, 2018.
Japanese Office Action in Japanese Patent Application No. 2017-536008, dated Oct. 3, 2018.
Chinese Office Action in Chinese Patent Application No. 201680008320.9, dated Nov. 21, 2018.
Chinese Office Action for Chinese Patent Application No. 201680008309.2, dated Oct. 8, 2018.
Communication from the European Patent Office dated Mar. 6, 2019 in European Patent Application No. 16 735 299.6.
Communication from the European Patent Office dated Mar. 6, 2019 in European Patent Application No. 16 735 298.8.
Notice of Allowance dated Mar. 3, 2020 in European Patent Application No. 16 735 299.6 (47 pages).
Final Office Action dated Apr. 20, 2020 in U.S. Appl. No. 14/591,478 (24 pages).
Third Office Action dated May 7, 2020 in Chinese Patent Application No. 201680008320.9.
Japanese Notice of Allowance dated Nov. 27, 2019 in Japanese Application No. 2017-536007.
Third Chinese Patent Office Action dated Feb. 25, 2020 in Chinese Patent Application No. 201680008309.2.
Second Office Action dated Sep. 3, 2019 in related Chinese Patent Application No. 20168008320.9.
U.S. Office Action dated Aug. 15, 2017 in related U.S. Appl. No. 14/591,478.
U.S. Office Action dated Nov. 14, 2017 in related U.S. Appl. No. 14/591,478.

(56) References Cited

OTHER PUBLICATIONS

U.S. Office Action dated Apr. 27, 2018 in related U.S. Appl. No. 14/591,478.
U.S. Office Action dated Nov. 23, 2018 in related U.S. Appl. No. 14/591,478.
Chinese Second Patent Office Action issued in Chinese Patent Application No. 201680008309.2 dated Jun. 5, 2019.
Communication pursuant to Article 94(3)EPC issued in European Patent Application No. 16 735 298.8 dated Sep. 30, 2019.
Communication pursuant to Article 94(3)EPC issued in European Patent Application No. 16 735 299.6 dated Sep. 30, 2019.
Notification of Decision of Rejection issued in Japanese Patent Application No. 2017-536007 dated May 24, 2019.
Notification of Decision of Rejection issued in Japanese Patent Application No. 2017-536008 dated Jun. 24, 2019.
Non-Final Office Action dated Oct. 1, 2019 in related U.S. Appl. No. 14/591,478 (13 pages).
U.S. Office Action dated Apr. 26, 2019 in related U.S. Appl. No. 14/591,478.
European Office Action dated Mar. 6, 2019 in related European Patent Application No. 16735299.6.
Japanese Office Action dated May 24, 2019 in related Japanese Patent Application No. 2017-536007.
Taiwan Notice of Allowance dated Apr. 10, 2017 in related Taiwanese Application No. 105100422.
European Office Action dated Mar. 6, 2019 in related European Patent Application No. 16735298.8.
European Office Action dated Sep. 30, 2019 in related European Patent Application No. 16735298.8.
Japanese Office Action dated Jun. 24, 2019 in related Japanese Patent Application No. 2017-536008.
Taiwanese Notice of Allowance dated Oct. 19, 2017 in related Taiwanese Patent Application No. 105100421.
Communication under Article 94(3) EPC dated Jul. 24, 2020 in European Patent Application No. 16735298.8.
Notice of Allowance dated Jul. 6, 2020 in Chinese Patent Application No. 201680008309.2.
Communication under Rule 71(3) EPC (Notice of Allowance) dated Mar. 10, 2021 in European Patent Application No. 16735298.8 (32 pages).
Notice of Allowance dated Feb. 3, 2021 in Chinese Patent Application No. 201680008320.9 (1 page) (1 page English Translation).
Notice of Allowance dated Mar. 4, 2021 in Japanese Patent Application No. 2019-14151 (3 pages) (8 pages English Translation).
Notice of Allowance dated Oct. 14, 2021 in U.S. Appl. No. 14/591,478.
Notice of Reason for Rejection dated Sep. 14, 2021 in Korean Patent Application No. 10-2017-7021442.
Notice of Reason for Rejection dated Oct. 1, 2021 in Korean Patent Application No. 10-2017-7021729.
Examination Report dated Oct. 7, 2021 in Indian Patent Application No. 201747023542.
Final Office Action dated Aug. 20, 2021 in U.S. Appl. No. 14/591,478.
Non-Final Office Action dated May 3, 2021 in U.S. Appl. No. 14/591,478.
Corrected Notice of Allowance dated Nov. 9, 2021 in U.S. Appl. No. 14/591,478.
Corrected Notice of Allowance dated Dec. 9, 2021 in U.S. Appl. No. 14/591,478.
Office Action dated Nov. 22, 2021 in Korean Patent Application No. 10-2017-7021442+(3 pages).

* cited by examiner

MAGNETIC CORE BASED ON A NANOCRYSTALLINE MAGNETIC ALLOY

BACKGROUND

1. Field

Embodiments of the invention relate to a magnetic core based on nanocrystalline magnetic alloy having high saturation induction, low coercivity and low iron-loss.

2. Background

Crystalline silicon steels, ferrites, cobalt-based amorphous soft magnetic alloys, iron-based amorphous and nanocrystalline alloys have been widely used in magnetic inductors, electrical choke coils, pulse power devices, transformers, motors, generators, electrical current sensors, antenna cores and electromagnetic shielding sheets. Widely used silicon steels are inexpensive and exhibit high saturation induction, $B_s$ but are lossy in high frequencies. One of the causes for high magnetic losses is that their coercivity $H_c$ is high, at about 8 A/m. Ferrites have low saturation inductions and therefore magnetically saturate when used in high power magnetic inductors. Cobalt-based amorphous alloys are relatively expensive and result in saturation inductions of usually less than 1 T. Because of their lower saturation inductions, magnetic components constructed from cobalt-based amorphous alloys need to be large in order to compensate the low levels of operating magnetic induction, which is lower than the saturation induction, $B_s$. Iron-based amorphous alloys have $B_s$ of 1.5-1.6 T which are lower than $B_s$~2 T for silicon steels. Clearly needed is a magnetic alloy having a saturation induction exceeding 1.6 T, and a coercivity $H_c$ of less than 8 A/m in order to produce an energy-efficient and small-sized magnetic core for the above-mentioned devices.

An iron-based nanocrystalline alloy having a high saturation induction and a low coercivity has been taught in an international application publication WO2007/032531 (hereinafter "the '531 publication"). This alloy has a chemical composition of $Fe_{100-x-y-z}Cu_xB_yX_z$ (X: at least one from the group consisting of Si, S, C, P, Al, Ge, Ga, and Be) where x, y, z are such that $0.1 \le x \le 3$, $10 \le y \le 20$, $0 < z \le 10$ and $10 < y+z \le 24$ (all in atom percent) and has a local structure in which crystalline particles with average diameters of less than 60 nm are distributed, occupying more than 30 volume percent of the alloy. This alloy contains copper, but its technological role in the alloy was not clearly demonstrated. It was thought at the time of the '531 publication that copper atoms formed atomic clusters serving as seeds for nanocrystals that grew in their sizes by post-material fabrication heat-treatment into having local structures defined in the '531 publication. In addition, it was thought that the copper clusters could exist in the molten alloy due to copper's heat of mixing being positive with iron according to the conventional metallurgical law, which determined the upper copper content in the molten alloy. However, it later became clear that copper reached its solubility limit during rapid solidification and therefore precipitated, initiating a nanocrystallization process. Under a super-cooled condition, in order to achieve an envisaged local atomic structure which enables initial nanocrystallization upon rapid solidification, the copper content, x, must be between 1.2 and 1.6. Thus the copper content range of $0.1 \le x \le 3$ in the '531 publication has been greatly reduced. These alloys are classified as P-type alloys in the present application. As a matter of fact, an alloy of the '531 publication was found brittle due to partial crystallization and therefore difficult to handle, although the magnetic properties obtained were acceptable. In addition, it was found that stable material casting was difficult because rapid solidification condition for the alloy of the '531 publication varied greatly by solidification speed. Thus, improvements over the products of the '531 publication have been desired.

SUMMARY

In the process of improving over the products of the '531 publication, it was found that fine nanocrystalline structures were formed in an alloy in accordance with embodiments of the present invention by rapid heating-up of the alloy originally having no cast-in fine crystalline particles. Also found was that the heat-treated alloy exhibited excellent soft magnetic properties, such as high saturation inductions exceeding 1.7 T. The alloys exhibiting these magnetic properties are designated as Q-type alloys in the present application. The nanocrystallization mechanism in a Q-type alloy according to embodiments of the present invention is different from that of related art alloys (see, for example, U.S. Pat. No. 8,007,600 and international patent publication WO2008/133301) in that substitution of glass-forming elements such as P and Nb by other elements results in enhancement of the thermal stability of the amorphous phase formed in the alloy during crystallization. Furthermore, the element substitution suppresses growth of the crystalline particles precipitating during heat-treatment. In addition, rapid heating of the alloy ribbon reduces atomic diffusion rate in the material, resulting in reduced number of crystal nucleation sites. It is difficult for the element P found in a P-type alloy to maintain its purity in the material, and P tends to diffuse at temperatures below 300° C., reducing alloy's thermal stability. Thus, P is not a desirable element in the alloy. Elements such as Nb and Mo are known to improve the formability of an Fe-based alloy in glassy or amorphous states but tend to decrease the saturation induction of the alloy as they are non-magnetic and their atomic sizes are large. Thus the contents of elements such as Mo and Nb in the preferred alloys should be as low as possible.

Although the growth of large crystallites during heat-treatment often encountered in the related art products is mitigated in the ribbon-form material, uniform heat-treatment must be assured in a magnetic core with larger dimensions such as laminated or toroidal shaped cores.

One aspect of the present invention, therefore, is to develop a process where heating rate during alloy's heat-treatment is increased, by which magnetic loss such as core loss is reduced in the nanocrystallized material, providing a magnetic component with improved performance.

One major aspect of the present invention is to provide a magnetic core based on optimally heat-treated alloys in the embodiment of the invention with the intention of core's use in transformers and magnetic inductors in power generation and management.

Considering all the effects of constituent elements described in the preceding paragraphs, an alloy may have the chemical composition of $Fe_{bal}\ Cu_xB_ySi_z$, where $0.6 \le x < 1.2$, $10 \le y \le 20$, $0 \le z \le 10$, $10 \le (y+z) \le 24$, the numbers being in atomic percent, and balance being Fe and the addition of various optional elements later described in this disclosure. The alloy may be cast into ribbon form by the rapid solidification method taught in U.S. Pat. No. 4,142,571, for example.

A rapidly solidified ribbon having the chemical composition given in the preceding paragraph may be heat-treated first at temperatures between 450° C. and 550° C. by directly contacting the ribbon on a metallic or ceramic surface, followed by a rapid heating of the ribbon at a heating rate of greater than 10° C./s above 300° C.

The heat-treatment of the preceding paragraph may be performed either in zero magnetic field or a predetermined magnetic field applied along ribbon's length or width direction, depending on the envisaged applications.

The heat-treatment process described above produces a local structure such that nanocrystals with average particles sizes of less than 40 nm are dispersed in the amorphous matrix and are occupying more than 30 volume percent.

A heat-treated ribbon according to the preceding paragraph has a magnetic induction at 80 A/m exceeding 1.6 T, a saturation induction exceeding 1.7 T and coercivity $H_c$ of less than 6.5 Nm. In addition, the heat-treated ribbon exhibited a core loss at 1.6 T and 50 Hz of less than 0.4 W/kg and a core loss at 1.6 T and 60 Hz of less than 0.55 W/kg.

A heat-treated ribbon may be wound into a toroidal core and then heat-treated at 400° C.-500° C. for 1 min.-8 hours with or without a magnetic field applied along ribbon's length direction. This annealing procedure with such a magnetic field is designated longitudinal field annealing in the present disclosure. When the ribbon is wound to form a core, the circumference direction of a core is the ribbon's length direction. Thus, annealing with a field applied along the circumference direction of a wound core is a form of longitudinal field annealing.

The toroidal core may have a ribbon radius of curvature from 10 mm to 200 mm when let loose and a ribbon relaxation rate, defined by $(2-R_w/R_f)$, that is larger than 0.93 where $R_w$ and $R_f$ are, respectively, ribbon radius of curvature prior to ribbon release and ribbon radius of curvature after its release and free of constraint.

The toroidal core may have $B_r/B_{800}$ exceeding 0.7, where $B_r$ and $B_{800}$ were induction at applied fields of 0 Nm (at remanence) and 800 A/m, respectively.

The toroidal core may have a core loss at 1.6 T and 50 Hz ranging from 0.15 W/kg to 0.4 W/kg (including values from 0.16 W/kg to 0.31 W/kg), a core loss at 1.6 T and 60 Hz excitations ranging from 0.2 W/kg to 0.5 W/kg (including values from 0.26 W/kg to 0.38 W/kg), respectively. The coercivity may be less than 4 A/m, and may be less than 3 A/m. The coercivity may be in a range of 2 A/m to 4 A/m, (including values in the range of from 2.2 Nm to 3.7 A/m).

The toroidal core may be fabricated into a transformer core, electrical choke, power inductor and the like.

The toroidal core may have a core loss, at 10 kHz, of 3 W/kg at 0.1 T induction, of 10 W/kg at 0.2 T induction and of 28 W/kg at 0.4 T induction.

The toroidal core may be fabricated into a transformer core, a power inductor core or the like operated at high frequencies.

The toroidal core may have a $B_{800}$ that is close to the saturation induction $B_s$ and is ranging from 1.7 T to 1.78 T.

The toroidal core may be heat-treated with a magnetic field applied along ribbon's width direction when the applied field along ribbon's length direction was zero. Since the ribbon width direction is transverse to the ribbon length direction, this procedure is designated as transverse field annealing in the present disclosure. By using a field along the ribbon's width direction, BH characteristics of the toroidal core can be modified. This procedure can be used to modify the effective permeability of the toroidal core.

A toroidal core according to the above paragraph may be utilized, for example, in a power inductor carrying a large electrical current, and utilized in a current transformer. Such current transformer can also be utilized in an electrical energy meter.

In a first aspect of the invention, a magnetic core includes: a nanocrystalline alloy ribbon having a composition represented by $Fe_{bal}\ Cu_xB_ySi_z$, where $0.6 \le x < 1.2$, $10 \le y \le 20$, $0 \le z \le 10$, $10 \le (y+z) \le 24$, and $0 \le a \le 10$, $0 \le b \le 5$, all numbers being in atomic percent, with the balance being Fe and incidental impurities, and where A is an optional inclusion of at least one element selected from Ni, Mn, Co, V, Cr, Ti, Zr, Nb, Mo, Hf, Ta and W, and X is an optional inclusion of at least one element selected from Re, Y, Zn, As, In, Sn, and rare earth elements, the nanocrylstalline alloy ribbon having a local structure such that nanocrystals with average particle sizes of less than 40 nm are dispersed in an amorphous matrix and are occupying more than 30 volume percent of the ribbon. The composition may be of any of the compositions discussed in this disclosure.

In a second aspect of the invention, in the magnetic core of the first aspect of the invention: the ribbon has been subjected to heat treatment at a temperature in a range of from 430° C. to 550° C. at a heating rate of 10° C./s or more for less than 30 seconds, with a tension between 1 MPa and 500 MPa applied during the heat treatment; and the ribbon has been wound, after the heat treatment, to form a wound core.

In a third aspect of the invention, in the magnetic core of the second aspect of the invention, wherein the core has been further heat-treated in wound form at a temperature from 400° C. to 500° C. for 1.8 ks-10.8 ks in a magnetic field of less than 4 kA/m applied along the core's circumference direction.

In a fourth aspect of the invention, in the magnetic core of any one of the first through third aspects of the invention, the core is a wound core, and a round portion of the core is comprised of a ribbon whose radius of curvature is between 10 mm and 200 mm when let loose, and the round portion of the core is such that a ribbon relaxation rate defined by $(2-R_w/R_f)$ is larger than 0.93, where $R_w$ and $R_f$ are, respectively, ribbon radius of curvature prior to ribbon release and ribbon radius of curvature after its release and free of constraint.

In a fifth aspect of the invention, in the magnetic core of any one of the second through fourth aspects of the invention, the nanocrystalline alloy ribbon has been heat-treated by an average heating rate of more than 10° C./s from room temperature to a predetermined holding temperature which exceeds 430° C. and less than 550° C., with the holding time of less than 30 seconds.

In a sixth aspect of the invention, in the magnetic core of any one of the second through fourth aspects of the invention, the nanocrystalline alloy ribbon has been heat-treated by an average heating rate of more than 10° C./s from 300° C. to a predetermined holding temperature which exceeds 450° C. and less than 520° C., with the holding time of less than 30 seconds.

In a seventh aspect of the invention, in the magnetic core of the sixth aspect of the invention, the holding time is less than 20 seconds in the process of constructing the core.

The core of the above first through seventh aspects of the invention may be utilized in a device that is an electrical power distribution transformer. The core of the above first through seventh aspects of the invention may have a coercivity in a range of 2 A/m to 4 A/m. The core of the above first through seventh aspects of the invention may be utilized in a device that is an electrical power distribution transformer or a magnetic inductor for electrical power management operated at commercial and high frequencies, with the magnetic core having a coercivity in a range of 2 A/m to 4 Nm, and may also have a core loss of 0.2 W/kg-0.5 W/kg at 60 Hz and 1.6 T and a core loss of 0.15 W/kg-0.4 W/kg at 50 Hz and 1.6 T, and having a $B_{800}$ exceeding 1.7 T. The core of the above first through seventh aspects of the invention may be utilized in a device that is a magnetic inductor for electrical power management operated at commercial and high frequencies, or a transformer utilized in power electronics, with the magnetic core having a core loss of less than 30 W/kg at 10 kHz and an operating induction level of 0.5 T, and having a $B_{800}$ exceeding 1.7 T.

In a further aspect of the invention, a method of manufacturing a magnetic core includes: heat treating an amorphous alloy ribbon at a temperature in a range of from 430° C. to 550° C. at a heating rate of 10° C./s or more for less than 30 seconds, with a tension between 1 MPa and 500 MPa applied during the heat treating, the ribbon a composition represented by $Fe_{bal}\ Cu_xB_ySi_z$, where $0.6 \le x < 1.2$, $10 \le y \le 20$, $0 \le z \le 10$, $10 \le (y+z) \le 24$, and $0 \le a \le 10$, $0 \le b \le 5$, all numbers being in atomic percent, with the balance being Fe and incidental impurities, and where A is an optional inclusion of at least one element selected from Ni, Mn, Co, V, Cr, Ti, Zr, Nb, Mo, Hf, Ta and W, and X is an optional inclusion of at least one element selected from Re, Y, Zn, As, In, Sn, and rare earth elements; and after the heat treating, winding the ribbon to form a wound core.

BRIEF DESCRIPTION OF THE DRAWINGS

The invention will be more fully understood and further advantages will become apparent when reference is made to the following detailed description of the embodiments and the accompanying drawings in which.

DESCRIPTION OF EMBODIMENTS

Figure 1:
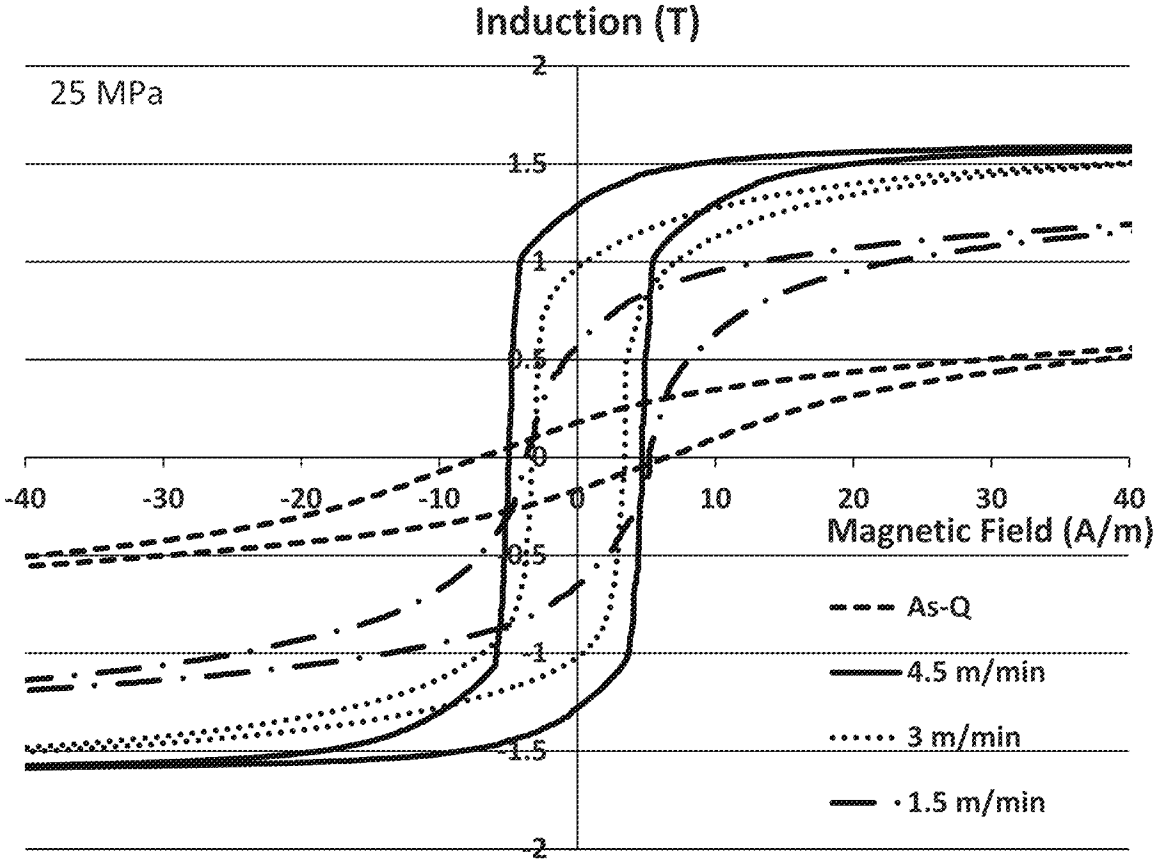
FIG. 1 illustrates the B-H behavior of a heat-treated ribbon according to embodiments of the present invention, where H is the applied magnetic field and B is the resultant magnetic induction.

A ductile metallic ribbon as used in embodiments of the invention may be cast by a rapid solidification method described in U.S. Pat. No. 4,142,571. The ribbon form is suitable for post ribbon-fabrication heat treatment, which is used to control the magnetic properties of the cast ribbon.

This composition of the ribbon used in embodiments of the invention comprises Cu in an amount of 0.6 to 1.2 atomic percent, B in an amount of 10 to 20 atomic percent, and Si in an amount greater than 0 atomic percent and up to 10 atomic percent, where the combined content of B and Si ranges from 10 through 24 atomic percent. The alloy may also comprise, in an amount of up to 0.01-10 atomic percent (including values within this range, such as a values in the range of 0.01-3 and 0.01-1.5 at %), at least one element selected from the group of Ni, Mn, Co, V, Cr, Ti, Zr, Nb, Mo, Hf, Ta and W. When Ni is included in the composition, Ni may be in the range of 0.1-2 or 0.5-1 atomic percent. When Co is included, Co may be included in the range of 0.1-2 or 0.5-1 atomic percent. When an element selected from the group of Ti, Zr, Nb, Mo, Hf, Ta and W is included, the total content of these elements may be at any value below 0.4 (including any value below 0.3, and below 0.2) atomic percent in total. The alloy may also comprise, in an amount of any value up to and less than 5 atomic percent (including values less up to and less than 2, 1.5, and 1 atomic percent), at least one element selected from the group of Re, Y, Zn, As, In, Sn, and rare earths elements.

Each of the aforementioned ranges for the at least one element selected from the group of Ni, Mn, Co, V, Cr, Ti, Zr, Nb, Mo, Hf, Ta and W (including the individually given ranges for Co and Ni) may coexist with each of the above-given ranges for the at least one element selected from the group of Re, Y, Zn, As, In, Sn, and rare earths elements. In any of the compositional configurations given above, the element P may be excluded from the alloy composition. All of the compositional configurations may be implemented subject to the proviso that the Fe content is in an amount of at least 75, 77 or 78 atomic percentage.

An example of one composition range suitable for embodiments of the present invention is 80-82 at. % Fe, 0.8-1.1 at. % or 0.9-1.1 at. % Cu, 3-5 at. % Si, 12-15 at. % B, and 0-0.5 at. % collectively constituted of one or more elements selected from the group of Ni, Mn, Co, V, Cr, Ti, Zr, Nb, Mo, Hf, Ta and W, where the aforementioned atomic percentages are selected so as to sum to 100 at %, aside from incidental or unavoidable impurities.

The alloy composition may consist of or consist essentially of only the elements specifically named in the preceding two paragraphs, in the given ranges, along with incidental impurities. The alloy composition may also consist of or consist essentially of only the elements Fe, Cu, B, and Si, in the above given ranges for these particular elements, along with incidental impurities. The presence of any incidental impurities, including practically unavoidable impurities, is not excluded by any composition of the claims. If any of the optional constituents (Ni, Mn, Co, V, Cr, Ti, Zr, Nb, Mo, Hf, Ta, W, Re, Y, Zn, As, In, Sn, and rare earths elements) are present, they may be present in an amount that is at least 0.01 at. %

In embodiments of the invention, the chemical composition of the ribbon can be expressed as $Fe_{100-x-y-z}Cu_xB_ySi_z$ where $0.6 \le x < 1.2$, $10 \le y \le 20$, and $10 \le (y+z) \le 24$, the numbers being in atomic percent. These alloys according to embodiments of the present invention are designated as Q-type alloys in the present application.

A Cu content of $0.6 \le x < 1.2$ is utilized because Cu atoms formed clusters serving as seeds for fine crystalline particles of bcc Fe, if $x \ge 1.2$. The size of such clusters, which affected the magnetic properties of a heat-treated ribbon, was difficult to control. Thus, x is set to be below 1.2 atomic percent. Since a certain amount of Cu was required to induce nanocrystallization in the ribbon by heat-treatment, it was determined that $Cu \ge 0.6$.

Because of the positive heat of mixing in the amorphous Fe—B—Si matrix, Cu atoms tended to cluster to reduce boundary energy between the matrix and the Cu cluster phases. In related art alloys, elements such as P or Nb were added to control the diffusion of Cu atoms in the alloys. These elements may be eliminated or minimized in the alloys in embodiments of the present invention as they reduced the saturation magnetic inductions in the heat-treated ribbon. Related art alloys having these elements are classified as P-type alloys in the present disclosure. Therefore, either one or both of the elements P and Nb may be absent from the alloy, or absent except in amounts that are incidental or unavoidable. Alternatively, instead of having P be absent, P may be included in the minimized amounts discussed in this disclosure.

Instead of controlling Cu diffusion by adding P or Nb to the alloys as described above, the heat-treatment process is modified in such a way that rapid heating of the ribbon did not allow for Cu atoms to have enough time to diffuse.

In the previously recited composition of $Fe_{100-x-y-z}Cu_xB_ySi_z$ ($0.6 \le x < 1.2$, $10 \le y \le 20$, $0 < z \le 10$, $10 \le (y+z) \le 24$), the Fe content should exceed or be at least 75 atomic percent, preferably 77 atomic percent and more preferably 78 atomic percent in order to achieve a saturation induction of more than 1.7 T in a heat-treated alloy containing bcc-Fe nanocrystals, if such saturation induction is desired. As long as the Fe content is enough to achieve the saturation induction exceeding 1.7 T, incidental impurities commonly found in Fe raw materials were permissible. These amounts of Fe being greater than 75, 77, or 78 atomic percent may be implemented in any composition of this disclosure, independently of the inclusion of Ni, Mn, Co, V, Cr, Ti, Zr, Nb, Mo, Hf, Ta and W, and of Re, Y, Zn, As, In, Sn, and rare earths elements discussed below.

In the previously recited composition of $Fe_{100-x-y-z}Cu_xB_ySi_z$ ($0.6 \le x < 1.2$, $10 \le y \le 20$, $0 < z \le 10$, $10 \le (y+z) \le 24$), up to from 0.01 atomic percent to 10 atomic percent, preferably up to 0.01-3 atomic percent and most preferably up to 0.01-1.5 atomic percent of the Fe content denoted by $Fe_{100-x-y-z}$ may be substituted by at least one selected from the group of Ni, Mn, Co, V, Cr, Ti, Zr, Nb, Mo, Hf, Ta and W. Elements such as Ni, Mn, Co, V and Cr tended to be alloyed into the amorphous phase of a heat-treated ribbon, resulting in Fe-rich nanocrystals with fine particle sizes and, in turn, increasing the saturation induction and enhancing the soft magnetic properties of the heat-treated ribbon. The presence of these elements (including in the ranges of individual elements discussed below) may exist in combination with the total Fe content being in an amount greater than 75, 77 or 78 atomic percentage.

Of the Fe substitution elements Ni, Mn, Co, V, Cr, Ti, Zr, Nb, Mo, Hf, Ta and W discussed above, Co and Ni additions allowed increase of Cu content, resulting in finer nanocrystals in the heat-treated ribbon and, in turn, improving the soft magnetic properties of the ribbon. In the case of Ni, its content was preferably from 0.1 atomic percent to 2 atomic percent and more preferably from 0.5 to 1 atomic percent. When Ni content was below 0.1 atomic percent, ribbon fabricability was poor. When Ni content exceeded 2 atomic percent, saturation induction and coercivity in the ribbon were reduced. In the case of Co addition, the Co content was preferably between 0.1 atomic percent and 2 atomic percent and more preferably between 0.5 atomic percent and 1 atomic percent.

Furthermore, of the Fe substitution elements of Ni, Mn, Co, V, Cr, Ti, Zr, Nb, Mo, Hf, Ta and W discussed above, elements such as Ti, Zr, Nb, Mo, Hf, Ta and W tended to be alloyed into the amorphous phase of a heat-treated ribbon, contributing to the stability of the amorphous phase and improving the soft magnetic properties of the heat-treated ribbon. However, the atomic sizes of these elements were larger than other transition metals such as Fe and soft magnetic properties in the heat-treated ribbon were degraded when their contents were large. Therefore, it was preferred that the content of these elements was below 0.4 atomic percent. Their contents were preferably below 0.3 atomic percent or more preferably below 0.2 atomic percent in total.

In the previously recited composition of $Fe_{100-x-y-z}Cu_xB_ySi_z$ ($0.6 \le x < 1.2$, $10 \le y \le 20$, $0 < z \le 10$, $10 \le (y+z) \le 24$), less than 5 atomic percent or more preferably less than 2 atomic percent of Fe denoted by $Fe_{100-x-y-z}$ may could be replaced by one from the group of Re, Y, Zn, As, In, Sn, and rare earths elements. When a high saturation induction was desired, the contents of these elements were preferably less than 1.5 atomic percent or more preferably less than 1.0 atomic percent.

The ribbon, in the compositions mentioned above, can be subjected to a first heat treatment, described as follows. The ribbon is heated with a heating rate exceeding 10° C./s to a predetermined holding temperature. When the holding temperature is near 300° C., the heating rate generally must exceed 10° C./s, as it considerably affects the magnetic properties in the heat-treated ribbon. It is preferred that the holding temperature exceed ($T_{x2}$−50) ° C., where $T_{x2}$ is the temperature at which crystalline particles precipitated. It is preferred that the holding temperature be higher than 430° C. The temperature $T_{x2}$ can be determined from a commercially available differential scanning calorimeter (DSC). The alloys of embodiments of the present invention crystallize in two steps when heated with two characteristic temperatures. At the higher characteristic temperature, a secondary crystalline phase starts to precipitate, this temperature being termed $T_{x2}$ in the present disclosure. When the holding temperature was lower than 430° C., precipitation and subsequent growth of fine crystalline particles was not sufficient. The highest holding temperature, however, was lower than 530° C. which corresponded to $T_{x2}$ of the alloys of embodiments of the present invention. The holding time was preferred to be less than 30 seconds or more preferred to be less than 20 seconds or most preferred to be less than 10 seconds. Some examples of the above process are given in Examples 1 and 2.

The heat-treated ribbon of the above paragraph was wound into a magnetic core which in turn was heat treated between 400° C. and 500° C. for the duration between 900 sec and 10.8 ks. For sufficient stress relief, the heat-treatment period was preferably more than 900 sec or more preferably more than 1.8 ks. When a higher productivity was desired, the heat-treatment period was less than 10.8 ks or preferably less than 5.4 ks. This additional process was found to homogenize the magnetic properties of a heat-treated ribbon. Example 3 shows some of the results (FIG. 4) obtained by the process described above.

In the heat-treatment process, a magnetic field was applied to induce magnetic anisotropy in the ribbon. The field applied was high enough to magnetically saturate the ribbon and was preferably higher than 0.8 kA/m. The applied field was either in DC, AC or pulse form. The direction of the applied field during heat-treatment was predetermined depending on the need for a square, round or linear BH loop. When the applied field was zero, a BH behavior with medium squareness ratio of 50%-70% resulted. Magnetic anisotropy was an important factor in controlling the magnetic performance such as magnetic losses in a magnetic material and ease of controlling magnetic anisotropy by heat-treatment of an alloy of embodiments of the present invention was advantageous.

Instead of a magnetic field applied during the heat-treatment, mechanical tension was alternatively applied. This resulted in tension-induced magnetic anisotropy in the heat-treated ribbon. An effective tension was higher than 1 MPa and less than 500 MPa. Examples of BH loops taken on the ribbon heat-treated under tension are shown in FIG. 1. Local magnetic domains observed are shown in FIGS. 2A-2C and 3.

EXAMPLE 1

A rapidly-solidified ribbon having a composition of $Fe_{81}Cu_{1.0}Si_4B_{14}$ was traversed on a 30 cm-long bronze plate heated at 490° C. for 3-15 seconds with a ribbon tension at 25 MPa. It took 5-6 seconds for the ribbon to reach the bronze-plate temperature of 490° C., resulting in a heating rate of 50-100° C./sec. The heat-treated ribbon was characterized by a commercial BH loop tracer and the result is given in FIG. 1, where the light solid line corresponds to the BH loop for an as-cast or as-quenched (As-Q) ribbon whereas the solid line, dotted line and semi-dotted line correspond to the BH loops for the ribbon tension-annealed with speeds at 4.5 m/min., 3 m/min., and 1.5 m/min., respectively.

Figure 2A:
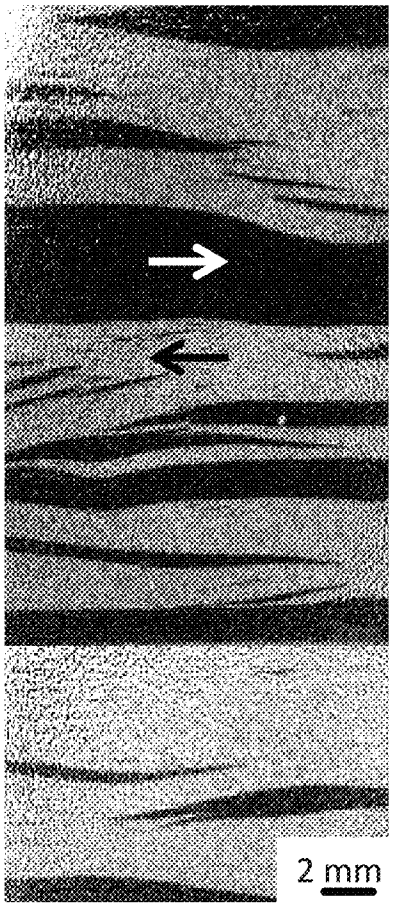
FIGS. 2A, 2B, and 2C depict the magnetic domain structures observed on flat surface (FIG. 2A), concave surface (FIG. 2B) and convex surface (FIG. 2C) of a heat-treated ribbon of an embodiment of the present invention. The directions of the magnetization in the two magnetic domains, shown in black and white, are 180° away from each other, as indicated by white and black arrows.
Figure 2B:
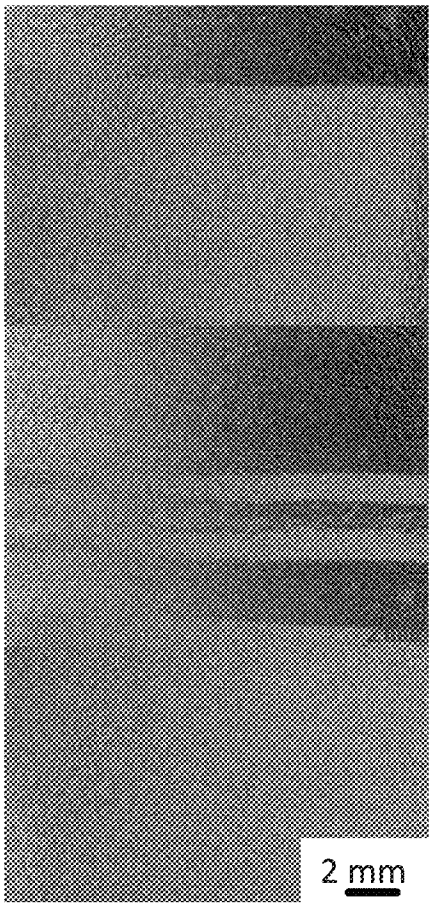
Figure 2C:
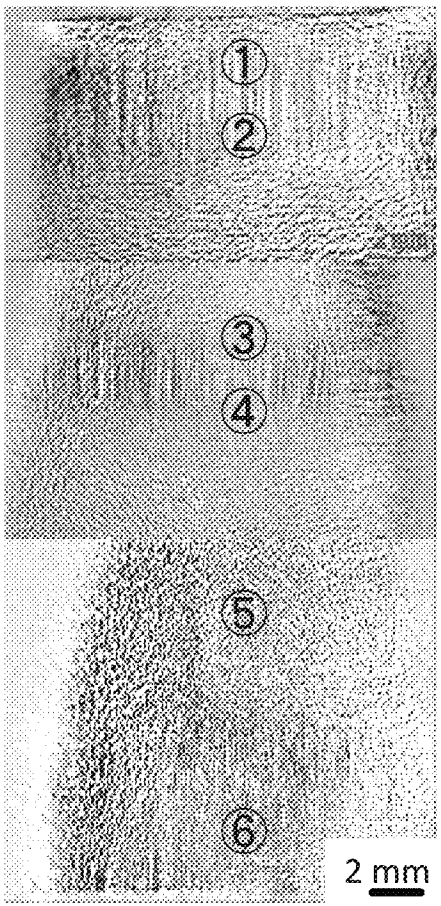

FIGS. 2A, 2B, and 2C show the magnetic domains observed on the ribbon of Example 1 by Kerr microscopy. FIGS. 2A, 2B, and 2C are from the flat surface, from the convex and from the concave surface of the ribbon, respectively. As indicated, the direction, indicated by a white arrow, of the magnetization in the black section pointed 180° away from the white section, indicated by a black arrow. FIGS. 2A and 2B indicate that the magnetic properties are uniform across the ribbon width and along the length direction. On the other hand on the compressed section corresponding to FIG. 2C, local stress varies from point to point.

Figure 3:
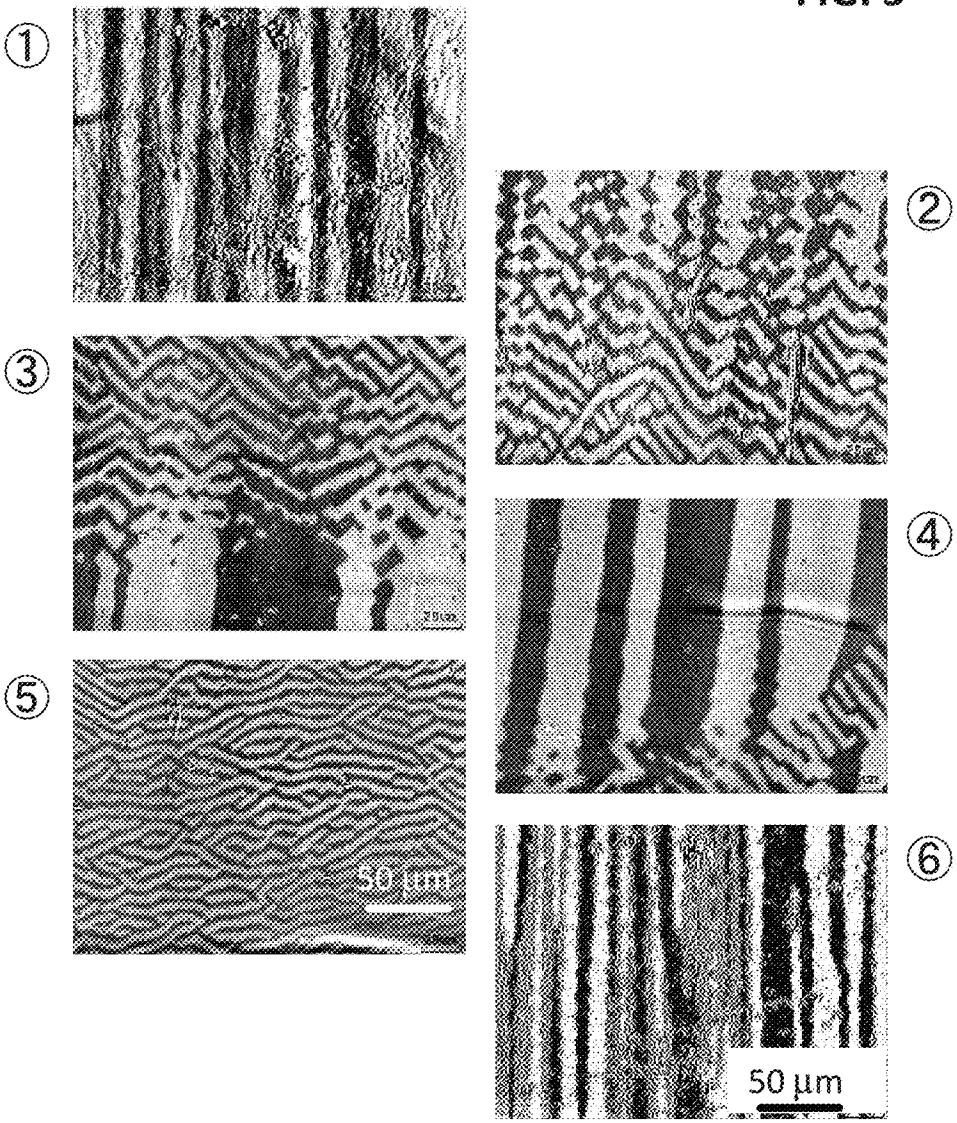
FIG. 3 shows the detailed magnetic domain patterns at points 1, 2, 3, 4, 5 and 6 indicated in FIG. 2C.

FIG. 3 shows the detailed magnetic domain patterns at ribbon section 1, 2, 3, 4, 5 and 6 in FIG. 2C. These domain patterns indicate magnetization directions near the surface of the ribbon, reflecting local stress distribution in the ribbon.

EXAMPLE 2

During first heat-treatment of a ribbon according to embodiments of the present invention, a radius of curvature developed in the ribbon, although the heat treated ribbon is relatively flat. To determine the range of radius of ribbon curvature, R (mm), in a heat-treated ribbon in which $B_{80}/B_{800}$ was greater than 0.90, $B_{80}/B_{800}$ ratio was examined as a function of ribbon radius of curvature which was changed by winding the heat treated ribbon on rounded surface with known radius of curvature. The results are listed in Table 1. The data in Table 1 are summarized by $B_{80}/B_{800}=0.0028R+0.48$. The data in Table 1 is used to design a magnetic core, for example, made from laminated ribbon.

TABLE 1

Radius of ribbon curvature versus $B_{80}/B_{800}$

| Sample | R, Radius of Ribbon Curvature (mm) | $B_{80}/B_{800}$ |
|---|---|---|
| 1 | ∞ | 0.98 |
| 2 | 200 | 0.92 |
| 3 | 150 | 0.89 |
| 4 | 100 | 0.72 |
| 5 | 58 | 0.65 |
| 6 | 25 | 0.55 |
| 7 | 12.5 | 0.52 |

Figure 4B:
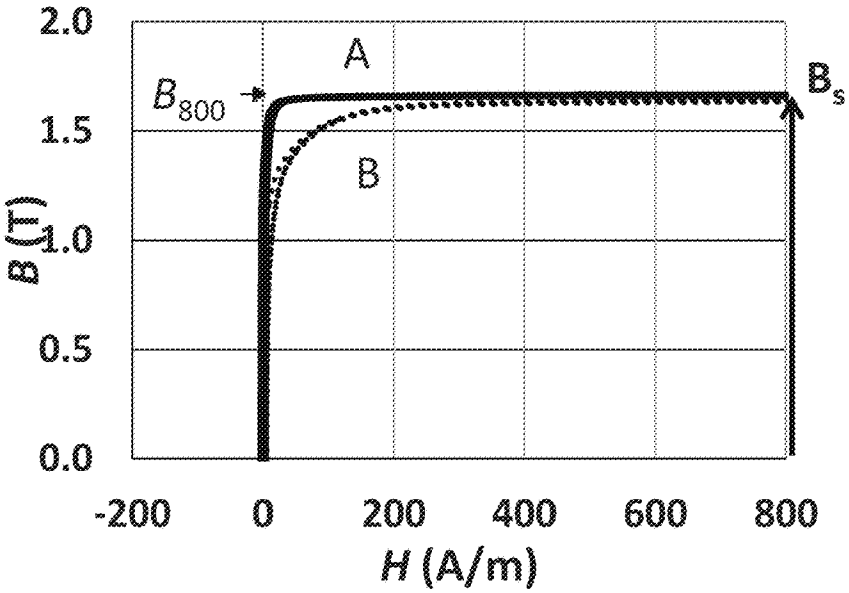
FIGS. 4A-4B show the upper half of the BH behavior taken on a sample with the composition of $Fe_{81}Cu_1Mo_{0.2}Si_4B_{13.8}$ annealed first with a heating rate of 50° C./s in a heating bath at 481° C. for 8 sec. and with a tension of 3 MPa, indicated by Curve B (dotted line), followed by secondary annealing at 430° C. for 5,400 sec. with a magnetic field of 1.5 kA/m, indicated by Curve A. The curves in FIG. 4A on the left and in FIG. 4B on the right are data taken up to a magnetic field of 80 A/m and 800 A/m, respectively. Also indicated are $B_{80}$, the induction at a field of 80 A/m and $B_{800}$, the induction at a field of 800 A/m. These quantities are used to characterize the magnetic properties of the alloys according to embodiments of the present invention.
Figure 4A:
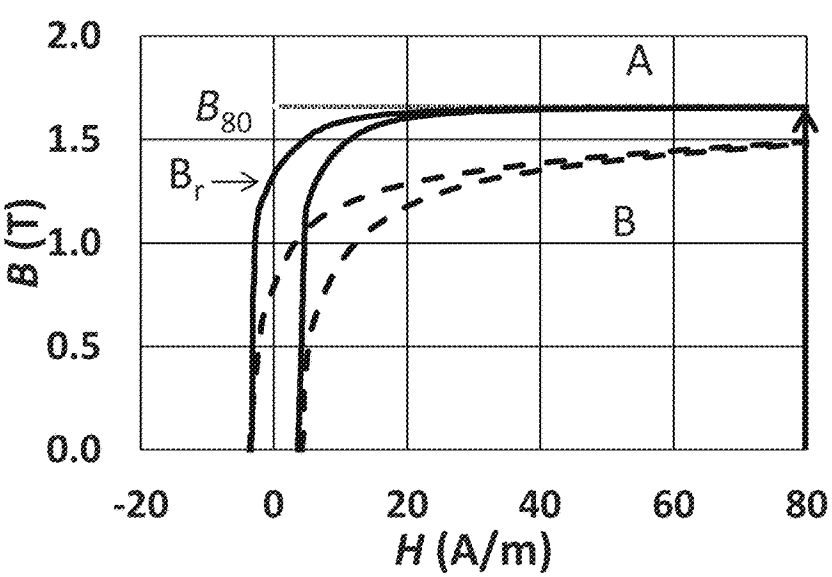

Sample 1 corresponds to the flat ribbon case of FIG. 2A in Example 1, where the magnetization distribution is relatively uniform, resulting in a large value of $B_{80}/B_{800}$, which is preferred. The quantities $B_{80}$, $B_{800}$, and $B_s$ (saturation induction) are defined in FIGS. 4A-4B. As shown in FIGS. 4A-4B, $B_{800}$ is close to $B_s$, the saturation induction, in the square BH loop materials of the present invention and in practical applications, $B_{800}$ is treated as $B_s$. In FIGS. 4A-4B, remanent induction, $B_r$, is defined by the induction at H=0.

EXAMPLE 3

Strip samples of $Fe_{81}Cu_1Mo_{0.2}Si_4B_{13.8}$ alloy ribbon were annealed on a hot plate first with a heating rate of more than 50° C./s in a heating bath at 470° C. for 15 sec., followed by secondary annealing at 430° C. for 5,400 seconds in a magnetic field of 1.5 kA/m. Another sample of trips of the same chemical composition were annealed first with a heating rate of more than 50° C./s in a heating bath at 481° C. for 8 seconds and with a tension of 3 MPa, followed by secondary annealing at 430° C. for 5,400 seconds with a magnetic field of 1.5 kA/m. Examples of BH loops taken on these strips before and after the secondary annealing are shown in FIGS. 4A-4B, by solid lines A after the secondary annealing and broken lines after the first annealing, respectively. The quantities $B_{80}$ (induction at field excitation at 80 A/m) and $B_{800}$ (induction at 800 A/m) are also indicated; these quantities are used to characterize the heat-treated materials of the present invention. As shown, the coercivity displayed in both lines is 3.8 A/m, which is less than 4 A/m. The $B_r$, $B_{80}$, and $B_{800}$ value for curve A is 1.33 T, 1.65 T, and 1.67 T, respectively. The $B_r$, $B_{80}$, and $B_{800}$ value for curve B is 0.78 T, 1.49 T, and 1.63 T, respectively.

EXAMPLE 4

A ribbon having the aforementioned $Fe_{100-x-y-z}Cu_xB_ySi_z$ composition was first heat-treated at temperatures between 470° C. and 530° C. by directly contacting the ribbon on a surface, of brass or Ni-plated copper, having a radius of curvature of 37.5 mm, followed by rapid heating of the ribbon at a heating rate of greater than 10° C./s above 300° C., with contacting time between 0.5 s and 20 s. The resulting ribbon had a radius of curvature between 40 mm and 500 mm. The heat-treated ribbon was then wound into a toroidal core, which was heat-treated at 400° C.-500° C. for 1.8 ks-5.4 ks (kilosecond).

A toroidal core according to the preceding paragraph was wound such that the ribbon radius of curvature was in a range of from 10 mm to 200 mm when let loose and that the ribbon relaxation rate defined by $(2-R_w/R_f)$ was larger than 0.93. Here, $R_W$ and $R_f$ are, respectively, ribbon radius of curvature prior to ribbon release and ribbon radius of curvature after its release and free of constraint.

Figure 5B:
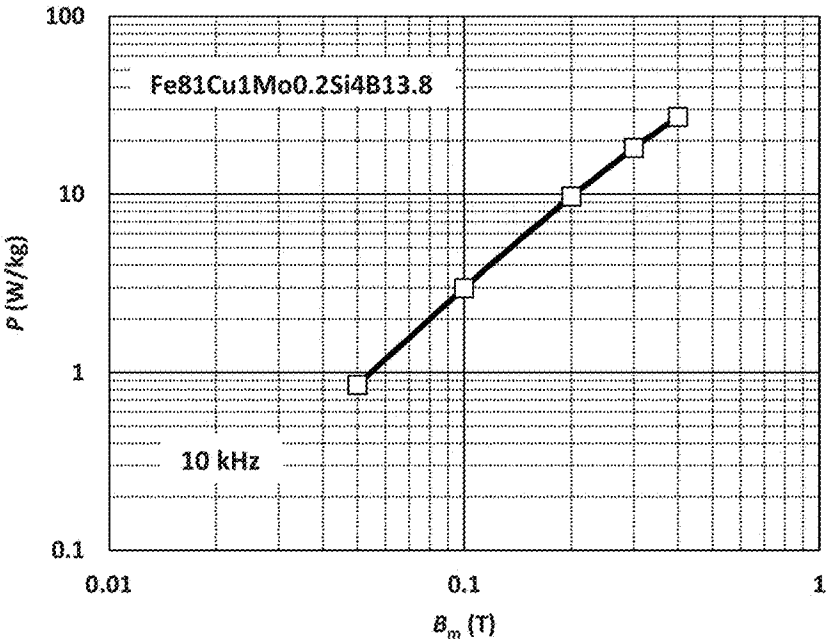
FIGS. 5A-5B show the upper half of the BH behavior (FIG. 5A) for a toroidal core made from an $Fe_{81}Cu_1Mo_{0.2}Si_4B_{13.8}$ alloy with the core size of (OD, ID)=(96.0, 90.0) listed in Table 2 and core loss, P(W/kg), as a function of the operating flux $B_m$ at frequency of 10 kHz in FIG. 5B.
Figure 5A:
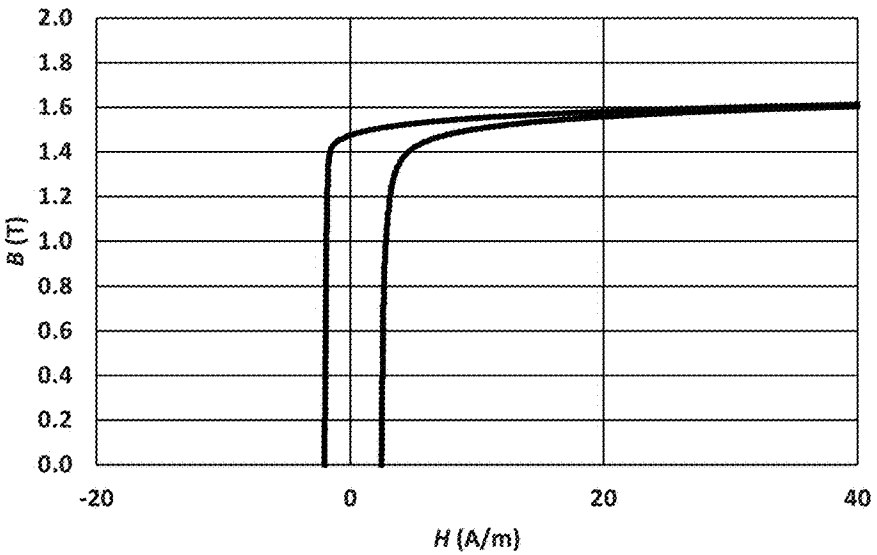

Toroidal cores having outside diameters (OD)=42.0 mm-130.5 mm, inside diameters (ID)=40.0 mm-133.0 mm and heights (H)=25.4 mm-50.8 mm were made from the annealed ribbon having BH loops generally characterized by FIG. 5A. The core height H was 25.4 mm for Alloy A, B and C and was 50.8 mm for Alloy D. The chemical compositions of Alloy A, B, C and D listed in Table 2 were $Fe_{81}Cu_1Mo_{0.2}Si_4B_{13.8}$, $Fe_{81}Cu_1Si_4B_{14}$, $Fe_{81.8}Cu_{0.8}Mo_{0.2}Si_{4.2}B_{13}$, and $Fe_{81}Cu_1Nb_{0.2}Si_4B_{13.8}$ respectively. The magnetic properties, such as core loss and exciting power of the toroidal cores, were characterized by the test method according to the ASTM A927 Standard. One example of core loss as a function of exciting flux density, Bm, taken on a core based on $Fe_{81}Cu_1Mo_{0.2}Si_4B_{13.8}$ ribbon is shown in FIG. 5B. Other relevant properties such as $B_{800}$, $B_r$ and $H_c$ were determined by the measurements of BH loops on the core samples. Some examples of these properties are listed in Table 2.

Figure 6A:
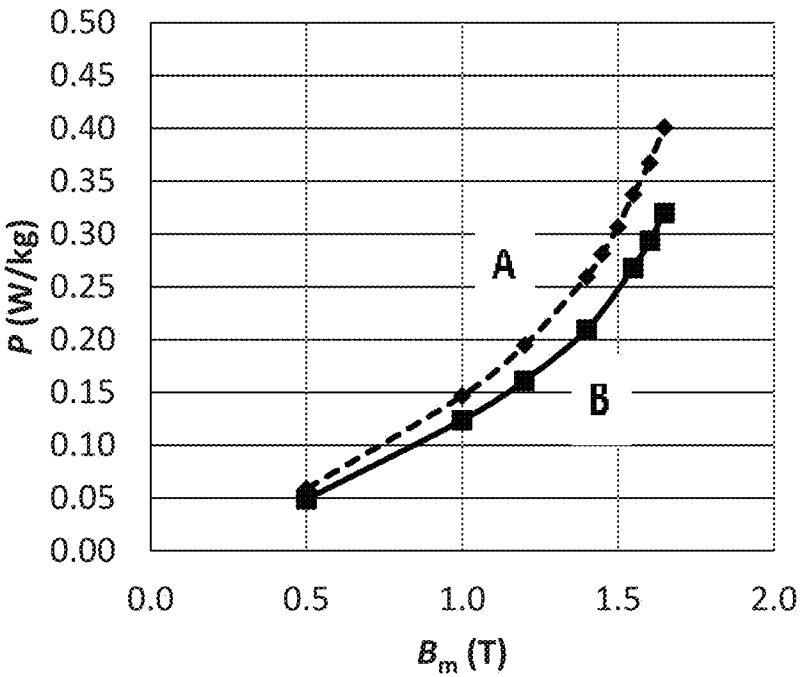
FIGS. 6A-6B show core loss at 60 Hz indicated by Curve A and at 50 Hz indicated by Curve B as a function of exciting flux density $B_m$ in FIG. 6A and BH loop in FIG. 6B. The core has the dimension of OD=153 mm, ID=117 mm and H=25.4 mm is wound from a ribbon with the chemical composition of $Fe_{81.8}Cu_{0.8}Mo_{0.2}B_{13}$.
Figure 6B:
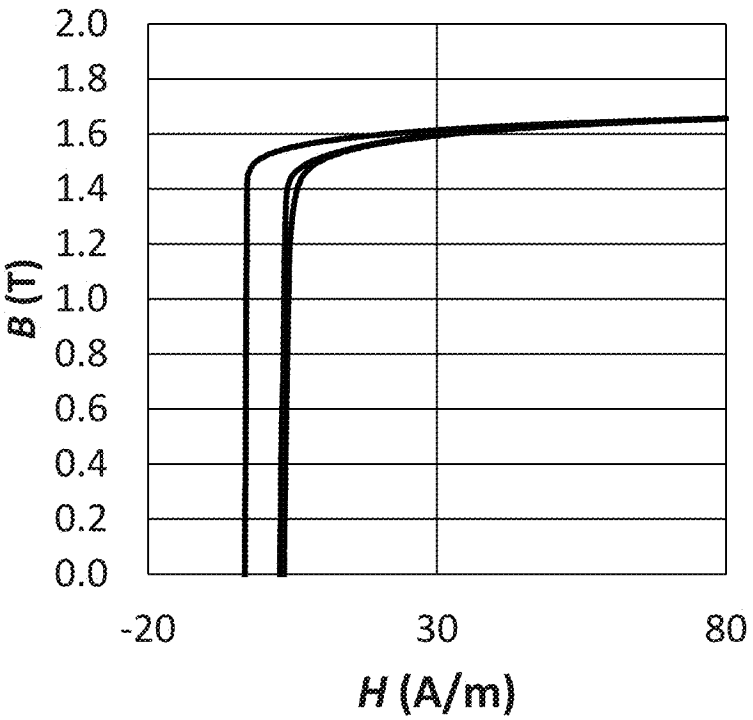

FIGS. 6A-6B show a graphical example of the magnetic properties obtained from a core with the dimensions of OD=153 mm, ID=117 mm and H=25.4 mm using an alloy having the composition of D given in Table 2 produced by first annealing at 499° C. for 1 second with 5 MPa ribbon tension and secondary annealing at 430° C. for 5.4 ks with a magnetic field of 2.2 kA/m applied along core's circumference direction.

TABLE 2

Physical and magnetic properties of toroidal cores of embodiments of the present invention. H = 25.4 mm for Alloys A, B and C; $t_c$ = ribbon contacting time; $P_{16/60}$ and $P_{16/50}$ are core loss at 1.6 T, and 60 Hz and 50 Hz excitation, respectively; $B_r$ is remanent and $B_{800}$ is induction at 800 A/m.

| Alloy | Core Size OD-ID (mm) | Primary Anneal T (° C.)-$t_c$ (sec)-Tension (MPa) | Secondary Anneal T (° C.)-$t_c$ (ks)-Field (kA/m) | Core Loss $P_{16/60}$ (W/kg) | Core Loss $P_{16/50}$ (W/kg) | $B_{800}$ (T) | $B_r/B_{800}$ | Hc (A/m) |
|---|---|---|---|---|---|---|---|---|
| A | 96.0-89.4 | 492-1-3 | 430-3.6-3.5 | | 0.30 | 1.70 | 0.81 | 3.7 |
| A | 96.0-90.0 | 504-1-3 | 430-3.6-3.5 | 0.26 | 0.22 | 1.71 | 0.86 | 2.2 |
| A | 114.0-71.0 | 500-2.2-3 | 430-3.6-3.5 | 0.31 | 0.24 | 1.70 | 0.77 | 2.6 |
| A | 72.0-70.0 | 483-4-15 | 430-3.6-4.5 | | 0.16 | 1.75 | 0.90 | 2.2 |
| A | 72.0-70.0 | 495-6-8 | 430-3.6-4.5 | | 0.18 | 1.70 | 0.80 | 2.8 |
| A | 96.1-90.3 | 524-1.1-3 | 430-3.6-3.5 | | 0.24 | 1.71 | 0.72 | 2.6 |
| A | 117.0-115.0 | 483-6-8 | No second anneal | | 0.22 | 1.74 | 0.75 | 3.3 |
| A | 130.5-133.0 | 483-6-8 | No second anneal | | 0.24 | 1.70 | 0.80 | 3.3 |
| B | 91.6-88.9 | 474-6-8 | 430-3.6-3.5 | | 0.29 | 1.75 | 0.90 | 2.5 |
| B | 93.3-89.6 | 485-2.2-3 | 430-3.6-3.5 | 0.34 | 0.28 | 1.74 | 0.96 | 2.1 |
| B | 90.7-88.9 | 483-6-8 | 430-3.6-3.5 | | 0.31 | 1.78 | 0.87 | 2.3 |
| B | 91.5-88.9 | 489-6-8 | 430-3.6-3.5 | | 0.28 | 1.77 | 0.85 | 2.2 |
| C | 117-153 | 499-1-5 | 430-3.6-3.5 | 0.37 | 0.29 | 1.73 | 0.90 | 2.2 |
| D | 98.5-90.0 | 500-1-3 | 430-3.6-3.5 | 0.38 | 0.30 | 1.70 | 0.92 | 2.2 |

Table 2 indicates that the alloys of embodiments of the present invention, when heat-treated, have saturation induction ranging from 1.70 T to 1.78 T and coercivity $H_c$ ranging from 2.2 A/m to 3.7 A/m. These are to be compared with $B_s$=2.0 T and $H_c$=8 A/m for 3% silicon steel, indicating that a magnetic core based on an alloy of embodiments of the present invention shows a core loss at 50/60 Hz operation of about ½ that of a conventional silicon steel. The data in Table 2 give core loss at 50 Hz/1.6 T and 60 Hz/1.6 T of 0.16 W/kg-0.31 W/kg and 0.26 W/kg-0.38 W/kg, respectively. Core loss at 50 Hz and 60 Hz at different induction levels are shown in FIG. 6A and FIG. 6B indicates that a narrow BH loop with a low coercivity ($H_c$<4 A/m) results in a low exciting power, which is the minimum energy to energize the magnetic core. Thus, these cores are suitable for cores utilized in electrical power transformers and in magnetic inductors carrying large electric current.

EXAMPLE 5

Figure 7:
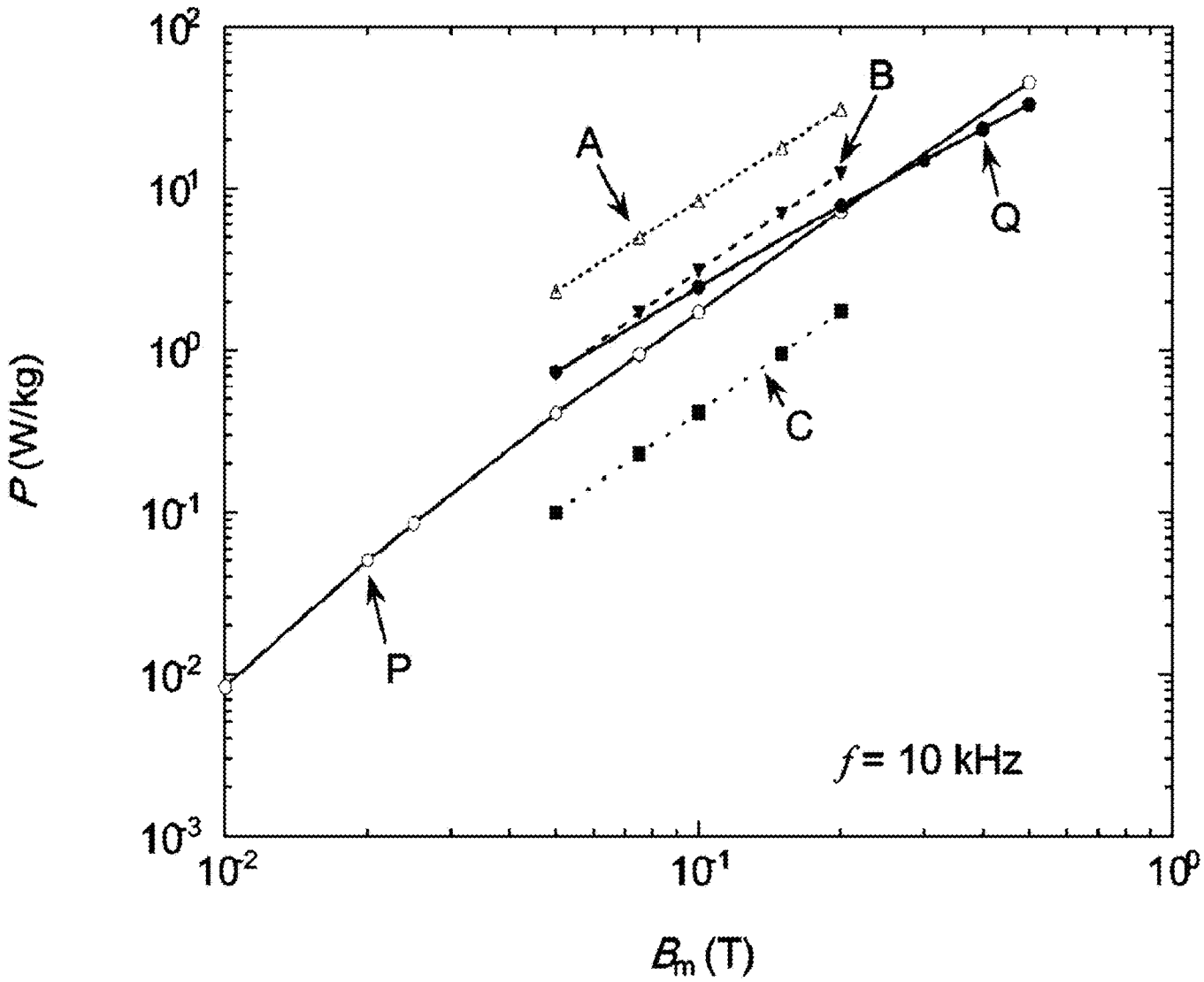
FIG. 7 compares core loss P(W/kg) versus operating induction $B_m$ (T) at frequency of 10 kHz for a typical P-type alloy (indicated by P) and a typical Q-type alloy (indicated by Q) according to embodiments of the present invention and conventional 6.5% Si-steel (A), Fe-based amorphous alloy (B), and nanocrystalline Finemet FT3 alloy (C).

High frequency magnetic properties of the toroidal cores of Example 4 were evaluated according to the ASTM A927 Standard. An example of core loss P(W/kg) versus operating flux $B_m$(T) is shown in FIG. 5B for a toroidal core with OD=96.0 and ID=90.0 and H=25.4 mm from Table 2. Similar data taken on another alloy of embodiments of the present invention indicated by Line Q are compared in FIG. 7 with those for a 6.5% Si-steel (Line A), amorphous Fe-based alloy (Line B), nanocrystalline Finement FT3 alloy (Line C) and related art P-type alloy (Line P). Since FT3 alloy has a saturation induction of 1.2 T which is much lower than those (1.7 T-1.78 T) of the present alloys, the alloys of embodiments of the present invention can be operated at much higher operating induction, enabling small magnetic components to be built. FIG. 7 also shows that core loss is lower in a core based on the alloys of the present invention than the prior art P-type alloys for operating magnetic induction levels exceeding 0.2 T at high frequencies. For example, FIG. 7 indicates that core loss at 10 kHz and 0.5 T induction of a magnetic core of the embodiment of the present invention is 30 W/kg which is compared with 40 W/kg for a prior art P-type alloy excited under the same condition. Thus, the magnetic cores of embodiments of the present invention are suited for use as power management inductors utilized in power electronics.

EXAMPLE 6

Figure 8B:
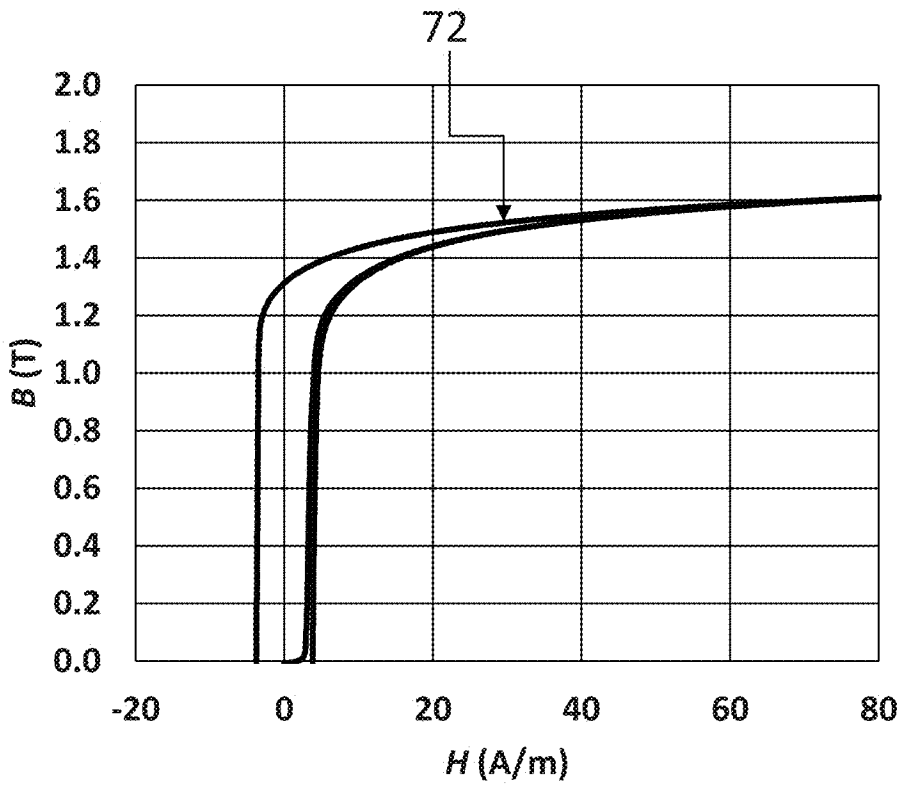
FIGS. 8A-8B shows an example of an oblong-shaped core according to an embodiment of the present invention (indicated by 71) and a DC BH loop (indicated by 72) taken on the core.
Figure 8A:
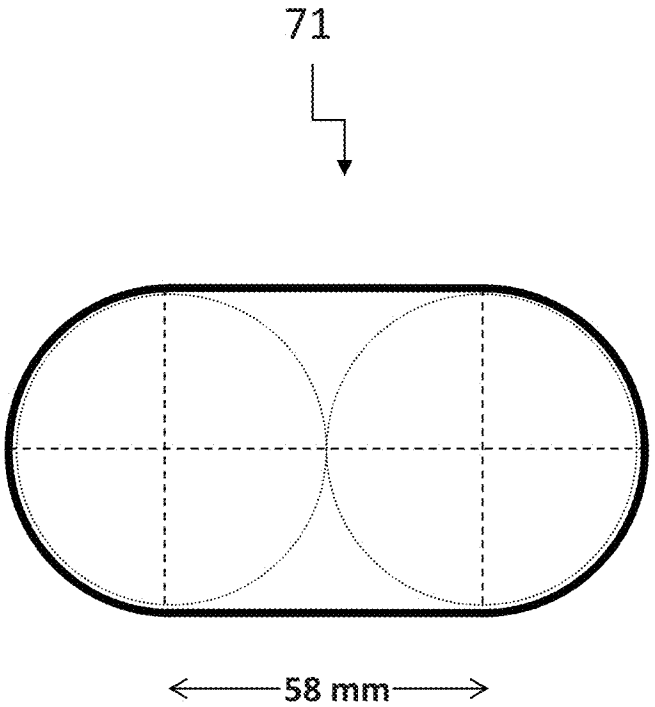
Figure 9:
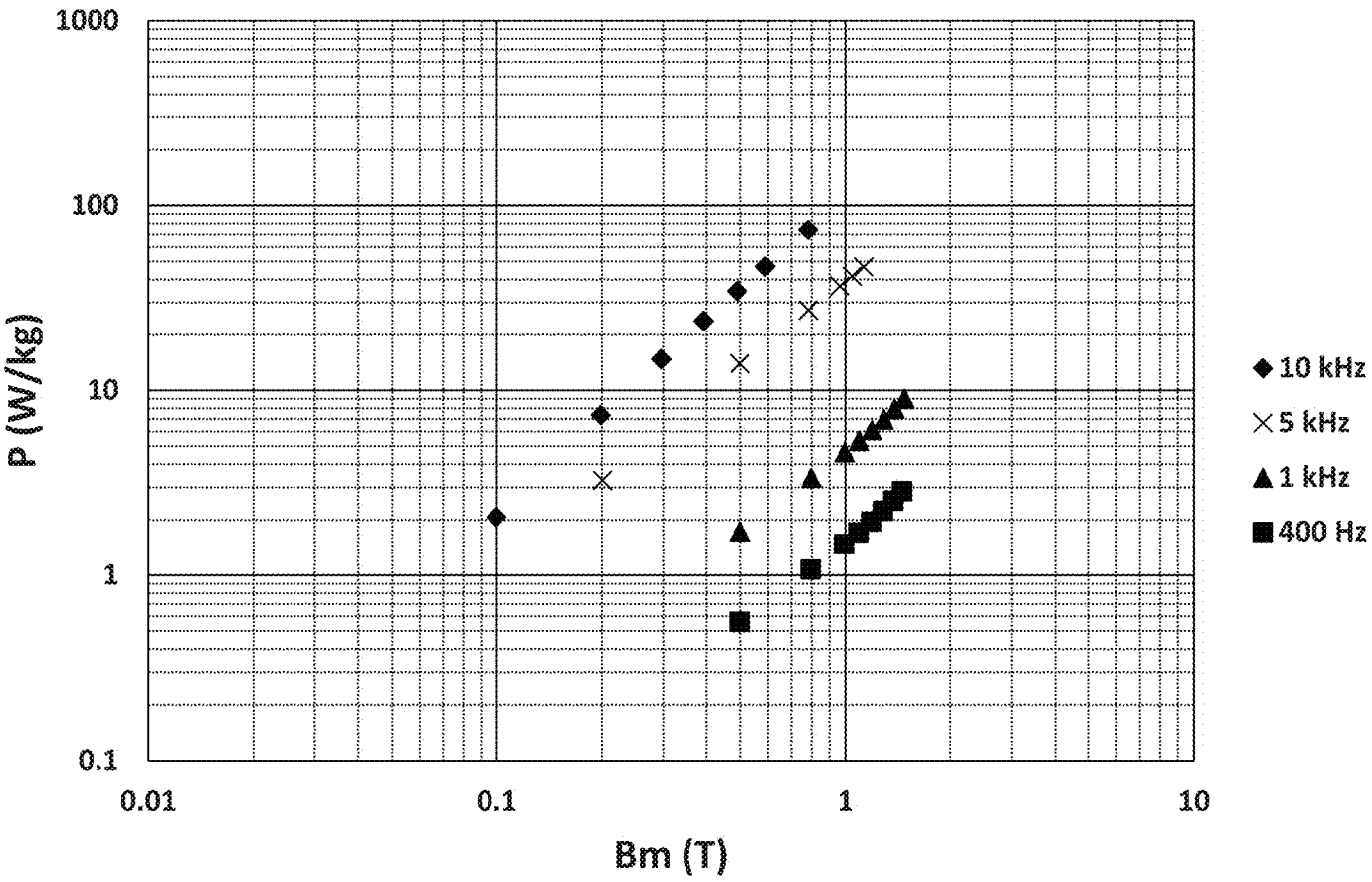
FIG. 9 gives core loss P (W/kg) as a function of core's operating flux density Bm(T) at frequencies of 400 Hz, 1 kHz, 5 kHz and 10 kHz, measured on the core of FIG. 8A.
Figure 10:
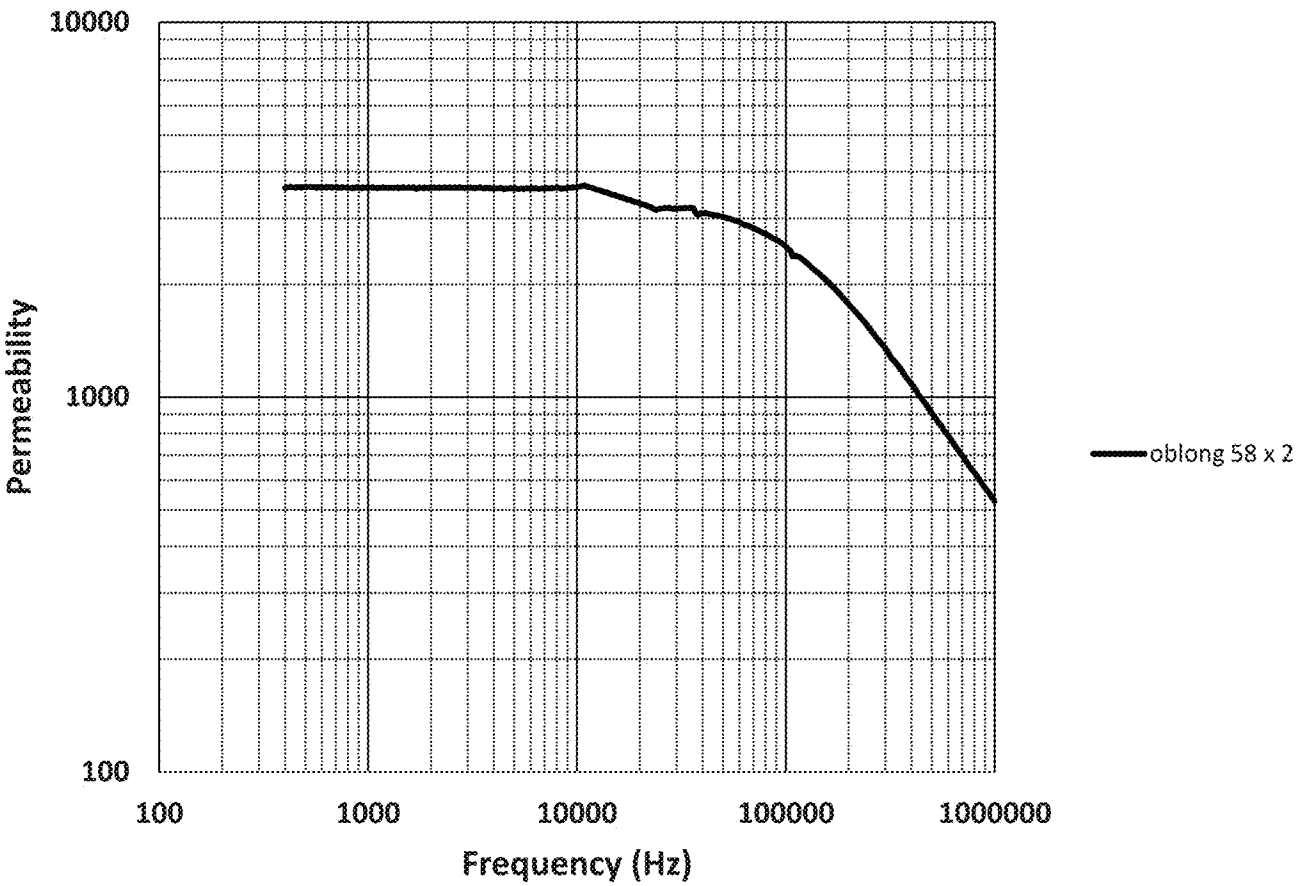
FIG. 10 shows Permeability versus operating Frequency on the core of FIGS. 8A-B.

A rapidly quenched ribbon was heat treated according to the first heat treatment process described earlier. The heat-treated ribbon was then wound into an oblong-shaped core as shown in FIG. 8A, where the straight-sections of the core had a length of 58 mm and the curved sections had a radius of curvature of 29×2 mm, and the inner side and outer side of the core had magnetic path lengths of 317 mm and 307 mm, respectively. The wound core was then heat-treated by the secondary annealing process described earlier in the first paragraph under "Example 4." A DC BH loop was then taken on the secondary-annealed core as in Example 1 and is shown by Curve 72 in FIG. 8B. Core loss was then measured in accordance with the ASTM A927 Standard and the results are shown in FIG. 9 as a function of core's operating flux density Bm (T) at the operating exciting frequencies of 400 Hz, 1 kHz, 5 kHz and 10 kHz. Permeability was measured as a function of frequency with the exciting field of 0.05 T and is shown in FIG. 10. It is noted that core loss at 10 kHz and 0.2 T induction is at 7 W/kg which is to be compared with the corresponding core loss of 10 W/kg measured with a toroidally wound core as shown in FIG. 5B. Thus, magnetic performance at high frequencies is not affected considerably by core shape and size, indicating stress introduced during core production is fully relieved by the secondary annealing of the embodiment of the present invention.

EXAMPLE 7

Figure 11B:
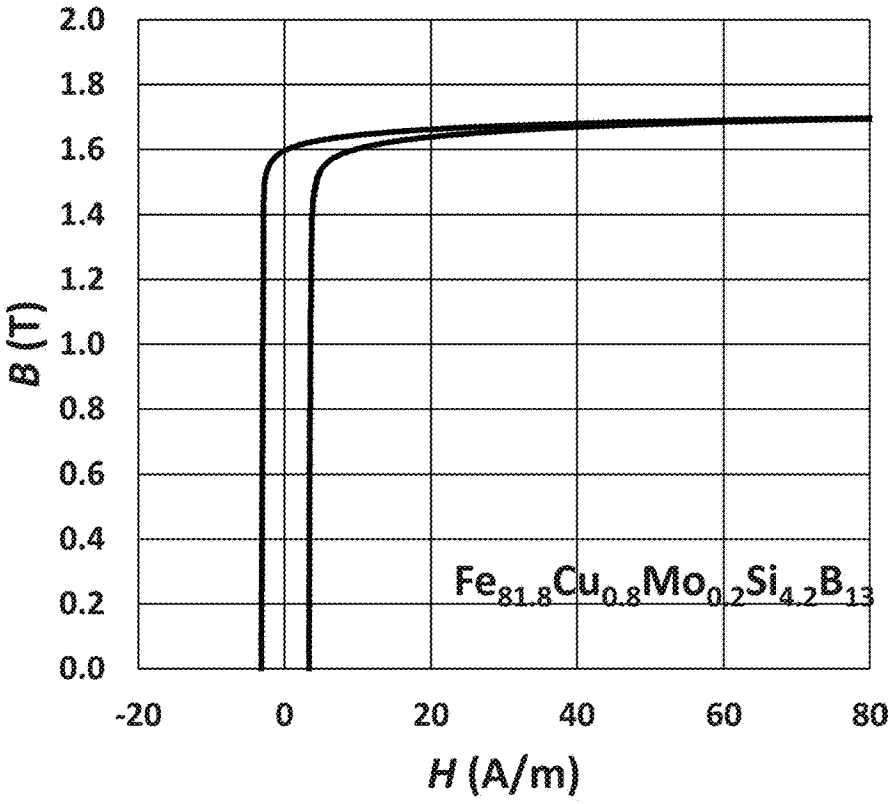
FIG. 11B shows the BH behavior of the core of FIG. 11A having undergone further heat-treatment, as a secondary annealing, at 430° C. for 5.4 ks with a magnetic field of 3.5 kA/m applied along the circumference direction of the core.
Figure 11A:
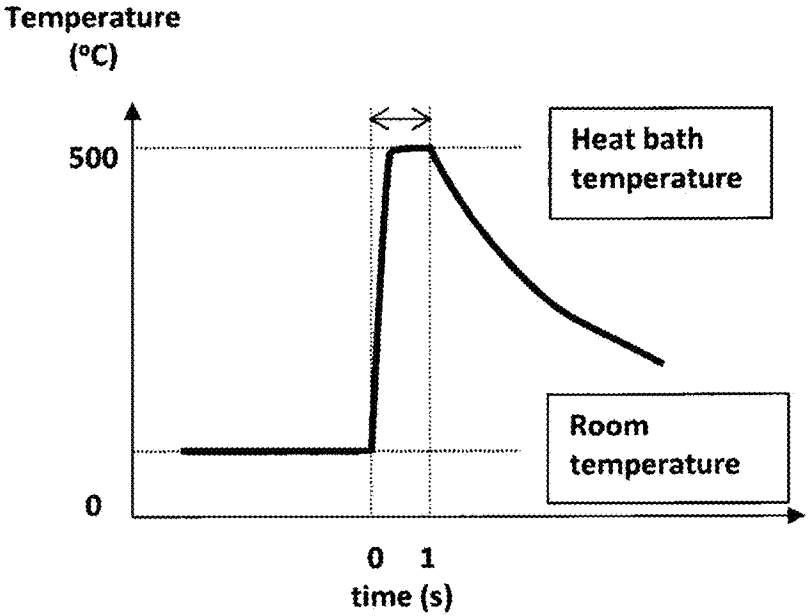
FIG. 11A shows the annealing temperature profile featuring rapid temperature increase of a core of an embodiment of the invention tested to 500° C. from room temperature and subsequent core cooling.

A 25.4 mm-wide ribbon with a chemical composition of $Fe_{81.8}Cu_{0.8}Mo_{0.2}Si_{4.2}B_{13}$ was rapidly heated up to 500° C. within 1 second under a tension of 5 MPa and was air-cooled, as shown by the heating profile of FIG. 11A. The heat-treated ribbon was then wound into a core with OD=96 mm, ID=90 mm and core height of 25.4 mm. The wound core was then heat treated at 430° C. for 5.4 ks with a magnetic field of 3.5 kA/m applied along the circumference direction of the core. When cooled to room temperature, the core's BH behavior was measured by a commercially available BH hysteresigraph as in Example 1. The result is shown in FIG. 11B, which gives a squareness ratio of 0.96, and coercivity of 3.4 A/m. This core is thus suited for applications operated at high inductions.

EXAMPLE 8

180° bend ductility tests were taken on the alloys of embodiments of the present invention and two alloys of the '531 publication (as comparative examples), as shown in Table 3 below. The 180° bend ductility test is commonly used to test if ribbon-shaped material breaks or cracks when bent by 180°. As shown, the products of the embodiments of the present invention did not exhibit failure in the bending test.

TABLE 3

| Composition | 180° bending |
|---|---|
| $Fe_{bal.}Cu_{0.6}Si_4B_{14}$ | passed |
| $Fe_{bal.}Cu_{1.0}Si_4B_{14}$ | passed |
| $Fe_{bal.}Cu_{1.1}Si_4B_{14}$ | passed |
| $Fe_{bal.}Cu_{1.15}Si_4B_{14}$ | partially possible |
| $Fe_{bal.}Cu_{0.8}Mo_{0.2}Si_{4.2}B_{13}$ | passed |
| $Fe_{bal.}Cu_{1.0}Mo_{0.2}Si_{4.2}B_{13}$ | passed |
| $Fe_{bal.}Cu_{1.0}Mo_{0.2}Si_4B_{14}$ | passed |
| $Fe_{bal.}Cu_{1.0}Mo_{0.5}Si_4B_{14}$ | passed |
| $Fe_{bal.}Cu_{1.2}Si_4B_{14}$ ('531 publication product) | failed |
| $Fe_{bal.}Cu_{1.3}Si_4B_{14}$ ('531 publication product) | failed |

As used throughout this disclosure, the term "to" includes the endpoints of the range. Therefore, "x to y" refers to a range including x and including y, as well as all of the intermediate points in between; such intermediate points are also part of this disclosure. Moreover, one skilled in the art would also understand that deviations in numerical quantities are possible. Therefore, whenever a numerical value is mentioned in the specification or claims, it is understood that additional values that are about such numerical value or approximately such numerical value are also within the scope of the invention.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A magnetic core comprising:

a nanocrystalline alloy ribbon having a composition represented by $Fe_{bal,}Cu_xB_ySi_zA_aX_b$, where 0.6 at. %≤x<1.2 at. %, 10 at. %≤y≤20 at. %, 0 at. %<z≤10 at. %, 10 at. %<(y+z)≤24 at. %, 0 at. %≤a≤10 at. %, and 0 at. %≤b≤5 at. %, at. % being atomic percent, and where A is an optional inclusion of at least one element selected from Ni, Mn, Co, V, Cr, Ti, Zr, Nb, Mo, Hf, Ta and W, X is an optional inclusion of at least one element selected from Re, Y, Zn, As, In, Sn, and rare earth elements, and a total content of Ti, Mo, Nb, Zr, Ta and Hf in the composition is below 0.3 atomic percent, the nanocrystalline alloy ribbon having a heat-treated local structure including nanocrystals with average particle sizes of less than 40 nm dispersed in an amorphous matrix and are occupying more than 30 volume percent of the nanocrystalline alloy ribbon, and the magnetic core having a coercivity of less than 4 A/m; and a magnetic induction at 80 A/m exceeding 1.6 T and below 1.75 T.

2. The magnetic core of claim 1, wherein the nanocrystalline alloy ribbon has been subjected to heat treatment at a temperature in a range of from 430° C. to 550° C. at a heating rate of 10° C./s or more for less than 30 seconds, with a tension between 1 MPa and 500 MPa applied during the heat treatment; and the nanocrystalline alloy ribbon has been wound, after the heat treatment, to form a wound core.

3. The magnetic core of claim 2, wherein the wound core has been further heat-treated in a wound form at a temperature from 400° C. to 500° C. for 1.8 ks-10.8 ks in a magnetic field of less than 4 kA/m applied along the wound core's circumference direction.

4. The magnetic core of claim 1, wherein the magnetic core is a wound core, and a round portion of the magnetic core is comprised of a ribbon whose radius of curvature is between 10 mm and 200 mm when let loose, and the round portion of the magnetic core is such that a ribbon relaxation rate defined by $(2-R_w/R_f)$ is larger than 0.93, where $R_w$ and $R_f$ are, respectively, ribbon radius of curvature prior to ribbon release and ribbon radius of curvature after ribbon release and when the magnetic core is free of constraint.

5. The magnetic core of claim 2, wherein the nanocrystalline alloy ribbon has been heat-treated by an average heating rate of more than 10° C./s from room temperature to a predetermined holding temperature which exceeds 430° C. and less than 550° C., and then held at the holding temperature for a holding time of less than 30 seconds.

6. The magnetic core of claim 2, wherein the nanocrystalline alloy ribbon has been heat-treated by an average heating rate of more than 10° C./s from 300° C. to a predetermined holding temperature which exceeds 450° C. and is less than 520° C., and then held at the holding temperature for a holding time of less than 30 seconds.

7. The magnetic core of claim 6, wherein the holding time is less than 20 seconds.

8. The magnetic core of claim 1, wherein the composition of the nanocrystalline alloy ribbon contains at least 78 at. % Fe.

9. The magnetic core of claim 1, wherein the composition of the nanocrystalline alloy ribbon contains from 0.01 atomic percent to 10 atomic percent of at least one selected from Ni, Mn, Co, V, Cr, Ti, Mo, and W.

10. The magnetic core of claim 9, wherein the composition of the nanocrystalline alloy contains one or more selected from Nb, Zr, Ta and Hf in an amount that is at least 0.01 atomic percent and below 0.3 atomic percent in total.

11. The magnetic core of claim 1, wherein in the composition of the nanocrystalline alloy ribbon, a total amount of Re, Y, Zn, As, In, Sn, and rare earth elements is in a range of from 0 atomic percent to less than 2.0 atomic percent.

12. The magnetic core of claim 11, wherein the total amount of Re, Y, Zn, As, In, Sn, and rare earth elements is in a range of from 0 atomic percent to less than 1.0 atomic percent.

13. An electrical power distribution transformer comprising the magnetic core of claim 1.

14. A magnetic inductor for electrical power management operated at commercial and high frequencies, comprising the magnetic core of claim 1.

15. A transformer utilized in power electronics, comprising the magnetic core of claim 1.

16. A device comprising the magnetic core of claim 1, the magnetic core having a core loss of 0.2 W/kg-0.5 W/kg at 60 Hz and 1.6 T and a core loss of 0.15 W/kg-0.4 W/kg at 50 Hz and 1.6 T, and having a $B_{800}$ exceeding 1.7 T, and the device being an electrical power distribution transformer, or a magnetic inductor for electrical power management operated at commercial and high frequencies.

17. A device comprising the magnetic core of claim 1, the magnetic core having a core loss of less than 30 W/kg at 10 kHz and an operating induction level of 0.5 T, and having a $B_{800}$ exceeding 1.7 T, and the device being a magnetic inductor for electrical power management operated at commercial and high frequencies, or a transformer utilized in power electronics.

18. The magnetic core of claim 1, having $B_f/B_{800}$ exceeding 0.8, and $B_{800}$ exceeding 1.7 T.

19. A method of manufacturing the magnetic core of claim 1, comprising:

producing the nanocrystalline alloy ribbon by heat treating a rapidly solidified ribbon, having the alloy composition, at a temperature in a range of from 430° C. to 550° C. at a heating rate of 10° C./s or more for less than 30 seconds, with a tension between 1 MPa and 500 MPa applied during the heat treating; and after the heat treating, winding the nanocrystalline alloy ribbon to form a wound core.

20. The method of claim 19, further comprising:

after the winding the nanocrystalline alloy ribbon, further heat treating the wound core in wound form at a temperature from 400° C. to 500° C. for 1.8 ks 10.8 ks in a magnetic field of less than 4 kA/m applied along the wound core's circumference direction.

21. The method of claim 19, wherein the heat treating before the winding is performed by heating the rapidly solidified ribbon at an average heating rate of more than 10° C./s from room temperature to a predetermined holding temperature which exceeds 430° C. and less than 550° C., and holding the heated ribbon at the holding temperature for a holding time of less than 30 seconds.

* * * * *